United States Patent [19]

Van Steenberg et al.

[11] 4,120,224

[45] Oct. 17, 1978

[54] SAW BLADE MOUNTING ARRANGEMENT

[76] Inventors: Wade M. Van Steenberg, Sigel, Pa. 15860; Florian O. Temchulla, 409 N. Penn. St., Punxsutawney, Pa. 15767

[21] Appl. No.: 825,224

[22] Filed: Aug. 17, 1977

[51] Int. Cl.[2] ..... B27B 5/32

[52] U.S. Cl. ..... 83/666; 83/698

[58] Field of Search ..... 83/666, 698; 30/388-391; 51/168; 144/238

[56] References Cited

U.S. PATENT DOCUMENTS

| | | | |
|---|---|---|---|
| 292,594 | 1/1884 | Sherman | 83/676 X |
| 683,942 | 10/1901 | Hyde | 51/168 |
| 764,399 | 7/1904 | Villiger, Jr. | 83/666 |
| 791,159 | 5/1905 | Norton | 51/168 |
| 2,665,722 | 1/1954 | Edgemond, Jr. | 144/238 |
| 3,483,902 | 12/1969 | Schiffers et al. | 83/666 |
| 3,894,462 | 7/1975 | Lundtoft | 83/665 |
| 4,018,256 | 4/1977 | Niehaus | 144/238 |

*Primary Examiner*—J. M. Meister

*Attorney, Agent, or Firm*—Webb, Burden, Robinson & Webb

[57] ABSTRACT

A rotary saw having an arbor with a threaded end portion and means to rotate the arbor. A circular saw blade on the arbor, a solid collar on the arbor rearwardly of said saw blade and a removable collar on the arbor forwardly of said saw blade. The periphery of the solid collar having an annular groove and an annular insert in the annular groove. Annular contact rims on the annular insert and on the removable collar to contact opposite faces of the saw blade when a retaining nut is tightened on the threaded end portion of the arbor.

4 Claims, 2 Drawing Figures

SAW BLADE MOUNTING ARRANGEMENT

Figure 2:
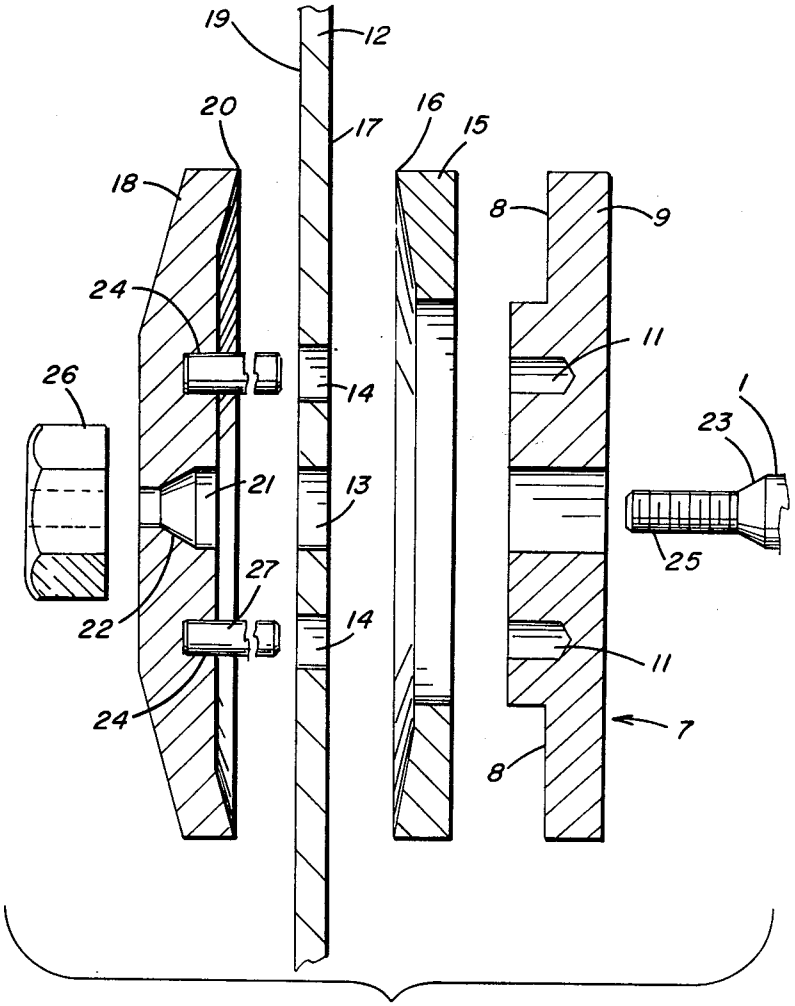

Our invention relates generally to rotary saws and more particularly to a mounting arrangement for rotary saw blades in saw mills.

In the operation of saw mills cutting logs into lumber, the blade is supported on the saw mill arbor by a pair of collars. The inner or solid collar eventually becomes worn at the outer periphery or rim where it contacts the rear face of the saw blade because of the pressure of the logs on the opposite face of the saw blade during sawing. When the rim of the solid collar becomes worn the saw blade leans away from the log toward the solid collar, and when this occurs the center portion of the saw blade rubs against the surface of the log and the friction between the log and the saw blade creates heat. The heated saw blade tends to expand during sawing and the outer periphery of the blade expands to a greater extent than the portion of the blade close to the eye. The different rates of expansion cause the saw blade to vibrate and to bind with the log during sawing. Continued use of the saw blade when the rim of the solid collar is worn increases the friction with the log and the resultant heat, and it is necessary to decrease the speed of the carriage which feeds the logs to the saw blade. The decreased feed rate decreases the friction between the saw blade and the log and the resulting heat, but is slows down the production of the mill.

In the past when the solid collar becomes worn, it is trimmed mechanically to restore the annular rim of the collar to its original shape which stops the blade from leaning and from rubbing against the log creating heat. This is an expensive operation since the mill must be shut down when the solid collar and the arbor are removed from the mill so that the solid collar can be trimmed. Alternatively, the arbor may be left in the mill and the solid collar trimmed in place, but this also requires shutdown of the mill and does not give especially good results.

In addition to the problem of trimming the solid collar, a saw blade which has been repeatedly heated by friction with logs becomes stressed. The stresses may be overcome by hammering the saw blade, but hammering a saw blade is a difficult procedure requiring a high degree of skill on the part of the person performing the hammering operation. By utilizing the arrangement of our invention the blade does not lean and, therefore, is not heated and subjected to different degrees of expansion so that hammering is eliminated to a great extent.

Our invention eliminates problems caused by a worn solid collar in saw mills cutting logs. Our invention permits replacement of an annular insert on the solid collar, and such is less time consuming and cheaper than replacing the collar. The worn insert may be removed and a spare inserted in a short period of time, on the order of 3-5 minutes. The insert is then trimmed at a location remote from the mill and returned to the mill ready for use. After trimming the insert of our invention, it is necessary to utilize a loose collar having a diameter equal to that of the rim of the insert. After the insert has been trimmed a number of times it is discarded, but the solid collar which supports the insert remains in good condition and is retained.

Figure 1:
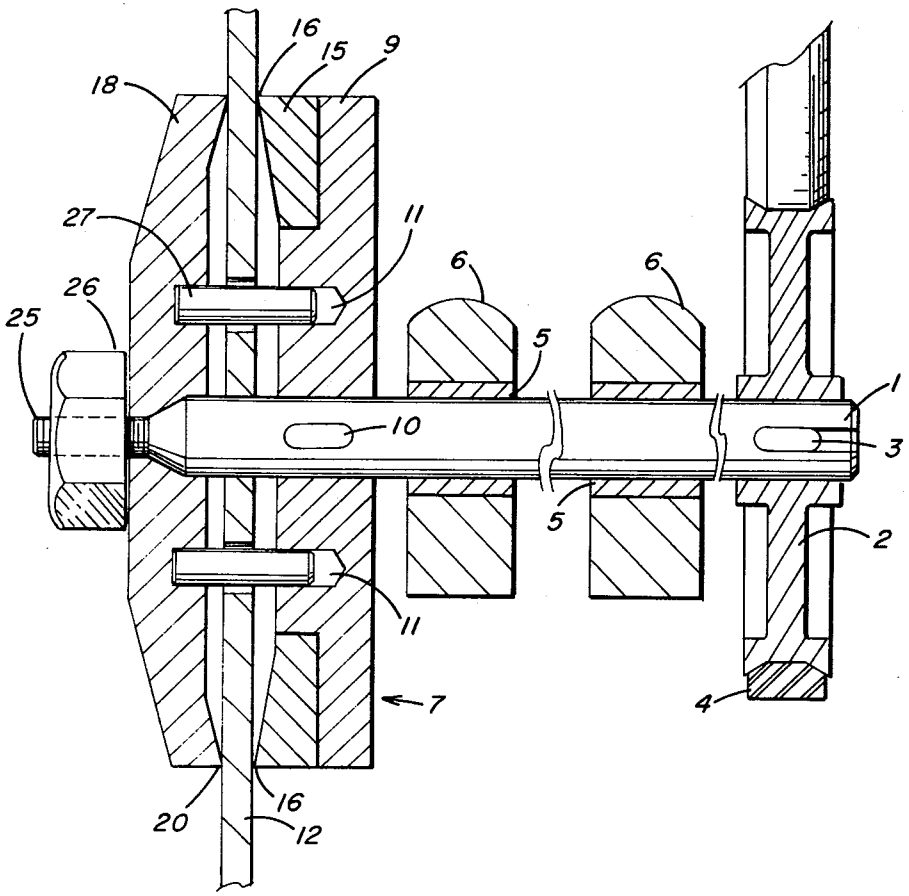

In the accompanying drawings:

FIG. 1 is a cross section through the arbor portion of a saw mill showing our invention; and FIG. 2 is an exploded view of the elements of our invention. With reference to FIG. 1 of the drawings, arbor 1 has a pulley 2 mounted at one end and held in place by a key 3 fitted into a keyway in the pulley and a complementary keyway in the arbor. The pulley is driven by a belt 4 from a standard motor or engine (not shown). The arbor carries sleeves 5 supported by bearings 6 held in standard bearing blocks (not shown). The pulley and drive mechanism therefor and the bearings supporting the arbor form no part of our invention. A solid collar 7 having a central opening is mounted on the end of the arbor opposite the end carrying pulley 2. Solid collar 7 is formed with an annular groove or recess 8 at its periphery 9. The solid collar is attached to the arbor by a key 10 which fits into complementary keyways in the arbor and in the solid collar. In addition to the annular recess 8, the solid collar is formed with a plurality of angularly spaced closed end openings 11 all of which are at the same radius from the center of the collar for a purpose to be described hereinafter. The exact spacing and location of openings 11 is not important. An annular insert 15 is fitted into the annular recess 8 in the solid collar in the manner shown in FIG. 1 of the drawings. The insert 15 has an annular contact rim 16 at or adjacent to its outer periphery which is formed with a sharp edge that bears against the rear face 17 of saw blade 12. Insert 15 fits into recess 8 and has an internal diameter slightly greater than the diameter of the shoulder of recess 8 so that the insert may be rapidly placed in the recess. The internal diameter of insert 15 and the diameter of the shoulder of the recess cannot differ by much since it is essential that the insert and the solid collar are concentric during operation of the saw.

A saw blade 12 having a central opening 13 is supported on the end of the arbor adjacent to the solid collar in the manner shown in FIG. 1 of the drawings. The saw blade is mounted substantially perpendicular to the axis of the arbor. The blade is formed with a plurality of openings 14 having the same radial and angular positions as openings 11 in the solid collar.

A loose collar 18 is fitted over the end of the arbor adjacent to the front face 19 of saw blade 15. The loose collar has an annular contact rim 20 at or adjacent to its outer periphery which has a sharp edge and which has the same diameter as annular contact rim 16 on insert 15. The loose collar is formed with a central opening 21 having a frustoconical portion 22 which fits over a frustoconical portion 23 adjacent to threaded end 25 on arbor 1. The loose collar is formed with a plurality of closed end openings 24 which have the same radial and angular positions as openings 14 in saw blade 12 and openings 11 in the solid collar.

When the loose collar is fitted on the end of the arbor, the frustoconical portion 22 of opening 21 in the loose collar contacts the frustoconical portion 23 of arbor 1. A retaining nut 26 is threaded onto threaded portion 25 of the arbor to force the annular contact rim 20 of the loose collar into engagement with the face 19 of saw blade 12. When the loose collar is in place on the arbor a plane including contact rim 20 will be substantially perpendicular to the axis of the arbor. At the same time the face 17 of saw blade 12 contacts the rim 16 on insert 15 and hold the insert in recess 8. The annular contact rims 16 on insert 15 and 20 on loose collar 18 prevent the saw blade from bending or leaning because of contact with the log during sawing. Thus, the blade, contact rim 20 and annular contact rim 16 are in substantially perpendicular relationship to the arbor axis.

When the blade and the collars are assembled on the arbor, retaining pins 27 extend through the openings 14 in the blade and into the closed end openings 11 in the solid collar and 24 in the loose collar. The pins have a tight fit in openings 11 so that they will stay in the openings when the loose collar and the saw blade are removed from the arbor. These retaining pins prohibit the blade from slipping relative to the arbor and the collars.

Eventually the rim 16 on insert 15 becomes worn due to the force applied to the saw blade by the log during sawing, and it is necessary to replace the insert. This is accomplished in a simple manner by removing nut 26 from the threaded end 25 of arbor 1 and removing the loose collar and the saw blade from the arbor. The insert is then removed from recess 8 and another insert having a sharp contact rim is fitted into the recess. After the new insert is placed in the recess in the solid collar, the saw blade and the loose collar are placed onto the arbor and the retaining pins 27, and the nut 26 is tightened on the threaded arbor end to force the collar rims into tight contact with the faces of the saw blade.

The replacement of insert 15 in recess 8 is accomplished in a short period of time which eliminates any substantial downtime for the mill. Additionally, because of frequent replacement of the insert, the saw blade will not lean to any great extent, and, therefore, it does not heat up and it need not be frequently hammered. As explained earlier in the specification, saw hammering is a time consuming operation which requires great skill and it is expensive.

While a preferred embodiment of our invention has been described herein, it will be understood that modifications may be made without departing from the scope of the invention as defined in the appended claims.

We claim:

1. In a rotary saw having an arobr with a threaded end, drive means for rotating said arbor, a circular saw blade mounted on said arbor, said saw blade being mounted in substantially perpendicular relationship to the axis of said arbor, a solid collar mounted on said arbor at one side of said saw blade, a removable collar mounted on said arbor at the opposite side of said saw blade from said solid collar having an annular rim contacting the saw blade, and a retaining nut on said threaded end of said arbor forcing said collars toward each other, the improvement comprising an annular groove formed at the periphery of said solid collar, an annular insert in said annular groove, said annular insert having a rim adapted to contact a face of said saw blade, the diameter of said rim on said insert and the diameter of said rim on said removable collar being the same, whereby said rims contact the opposite faces of said saw blade when said retaining nut is tightened on the threaded end of said arbor to force said removable collar and said saw blade toward said solid collar.

2. The rotary saw set forth in claim 1 wherein said solid collar has a plurality of angularly spaced closed end openings located radially outward from said arbor, said removable collar having a plurality of angularly spaced closed end openings having the same radial and angular spacing as said openings in said solid collar, a plurality of openings through said saw blade having the same angular and radial spacing as said openings in said removable and solid collars, and a pin extending through each opening in said saw blade into a complementary opening in said solid collar and a complementary opening in said removable collar.

3. The rotary saw set forth in claim 1 wherein said rim on said insert and said rim on said loose collar are located at the periphery of said insert and said loose collar.

4. The rotary saw set forth in claim 1 wherein said rims have sharp contact edges.

* * * * *